United States Patent [19]

Perry

[11] 4,412,786

[45] Nov. 1, 1983

[54] POSITIVE DISPLACEMENT PUMP

[76] Inventor: John C. Perry, 3170 Falcon Dr., Carlsbad, Calif. 92008

[21] Appl. No.: 320,456

[22] Filed: Nov. 12, 1981

[51] Int. Cl.[3] ..... F04F 7/00

[52] U.S. Cl. ..... 417/241

[58] Field of Search ..... 417/211, 240, 241

[56] References Cited

U.S. PATENT DOCUMENTS

| | | | |
|---|---|---|---|
| 2,645,184 | 7/1953 | Lowe | 417/211 |
| 2,969,761 | 1/1961 | Youtie | 417/211 |
| 3,116,695 | 1/1964 | Faller | 417/241 |
| 3,289,594 | 12/1966 | Thiele | 417/241 |
| 3,737,253 | 6/1973 | Foote | 417/241 |
| 4,370,101 | 1/1983 | Horst | 417/241 |

FOREIGN PATENT DOCUMENTS

| | | | |
|---|---|---|---|
| 113797 | 3/1925 | Switzerland | 417/240 |
| 130332 | 7/1920 | United Kingdom | 417/241 |

*Primary Examiner*—William L. Freeh

*Attorney, Agent, or Firm*—Robert G. Upton

[57] ABSTRACT

This invention relates to a positive displacement pump. The pump utilizes a source of rotary motion in the back and forth, clockwise, counterclockwise direction. The rotary oscillatory motion drives an annular piston weight mass in a toroidal rotary track, back and forth within the track in combination with at least a pair of one-way valves to pump fluid through the pump. Specially designed electric motors that rock back and forth, without a 360° rotation, for example, may be coupled to a positive displacement pump of this invention. In the medical profession, this pump may be used to pump liquids at a very slow, precise rate to transmit, for example, a variety of medications into a patient.

1 Claim, 5 Drawing Figures

POSITIVE DISPLACEMENT PUMP

CROSS-REFERENCE TO RELATED APPLICATIONS

This invention is related to VIBRATION ACTUATED LIQUID PUMP, Ser. No. 252,383, filed Apr. 9, 1981, and VIBRATION ACTUATED LIQUID PUMP, Ser. No. 303,216, filed Sept. 18, 1981, assigned to the same assignee as the present invention.

BACKGROUND OF THE INVENTION

1. Field of the Invention

This invention relates to positive displacement pumps.

More particularly, this invention relates to positive displacement pumps that convert oscillatory clockwise, counterclockwise motion into pumping motion by affecting a weight mass housed within a circular track to drive a fluid through at least a pair of cooperating one-way valves.

2. Description of the Prior Art

There are many types of positive displacement pumps in the prior art.

An example of the state of the art technology readily available in the Patent and Trademark Office is U.S. Pat. No. 2,572,977. This invention describes a piston within a housing with an inlet valve in one end of the housing, a valve in the hollow piston and a third valve at the exit end of the housing. The valve in the inlet end of the housing cooperates with the valve in the piston. As the piston moves away from the inlet end of the housing, fluid is drawn into the inlet end and, as the piston moves toward the inlet end, fluid is driven through the one-way valve within the piston to fill a chamber on the exit end of the piston. As the piston oscillates toward the exit end of the housing, fluid is driven out of the third valve which allows fluid to escape through the valve and out of the pumping device. This invention is disadvantaged in that it is directly connected to an oscillatory power source which mechanically links the pumping device to the power source and the power source is a sole motivational means for oscillating the piston mass within the housing. The oscillatory power source drives the piston linearly within the cylinder and, if the cylinder is not aligned with the oscillatory motion, then the pumping device is less efficient. This phenomenon is explained in detail in copending patent application Ser. Nos. 252,383 and 303,216.

The present invention takes advantage of a rotational, back and forth oscillatory motion in that the housing of the positive displacement pump defines an annular path for the pumping means so that rotational oscillatory motion (back and forth rotational motion) causes the fluid driving force within the annular track to drive fluid through the pump.

SUMMARY OF THE INVENTION

It is an object of this invention to provide a positive displacement fluid pump driven solely by rotational oscillatory motion.

It is yet another object of this invention to provide a positive displacement liquid pump, the driving force within the pump being confined within an annular path so that rotational motion clockwise and counterclockwise will force fluid through the pump and out the exit end of the pump at a rate controlled solely by the back and forth rotational motion associated with the annular pump.

A fluid pump, actuatable by a rotary vibrational force, is disclosed with a housing having a fluid inlet and a fluid outlet formed therein. An annular channel is formed by the housing. A first end of the annular channel is in fluid communication with the fluid inlet. A second end of the annular channel communicates with the fluid outlet formed in the housing of the pump. A weight mass is positioned within the annular channel, the weight mass being free to move within the channel clockwise and counterclockwise. A first one-way valve means is positioned adjacent the inlet end of the housing. A second one-way valve means is positioned adjacent the fluid outlet end of the housing. A source of fluid is connected to the fluid inlet end and a source of rotary oscillating energy is positioned adjacent the housing. The rotary oscillatory motion causes the weight mass within the housing to move clockwise and counterclockwise within the annular channel formed in the housing. As the weight mass rotates away from the first one-way valve adjacent the inlet, drawing fluid from the fluid source into an increased volume within the channel behind the weight mass, and, as the weight mass reverses its rotational movement back towards the first one-way valve, the first valve closes. As the weight mass again reverses direction, the second one-way valve opens. The weight mass thereby forces fluid out of the second valve pumping fluid through the pump.

An advantage over the prior art is the nonparasitic attachment to a source of rotational vibration motion to drive a positive displacement pump means.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
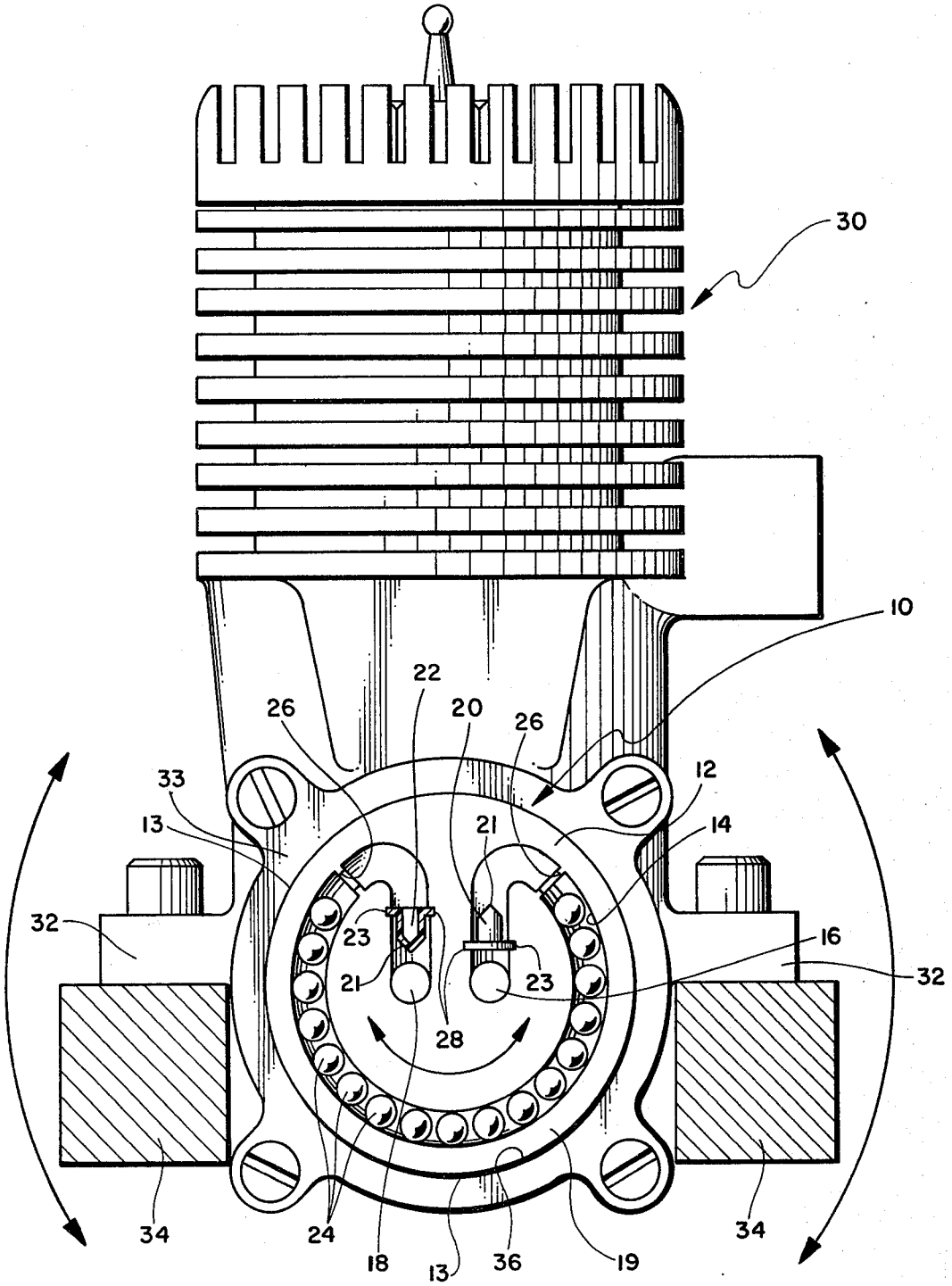
FIG. 1 is a partially cutaway view of a two-cycle internal combustion engine with an annular positive displacement pump positioned within a recess in the backplate of the two-cycle engine.

Turning to FIG. 1, the rotational positive displacement pump, generally designated as 10, is interference fitted within an engine backplate 33 of, for example, an internal combustion engine, generally designated as 30. The positive displacement pump 10 is, for example, interference fitted within the annular recess 36 of backplate 33 by contacting peripheral edge 13 of body 12 with the walls of the recess 36. The pump body 12 is made up of two body halves 15 and 17. On the inner half 15 of body 12 is formed one-half of an annular toroidal track 14, circular in cross section. One end of the annular track 14 defines a fluid inlet 16. The opposite end of the track 14 terminates at fluid outlet end 18. When the mating surfaces 19 of body halves 15 and 17 come together, the half toroid formed in each section 15 and 17 form an annular toroidal track 14. Within rack 14 is confined a pair of valves 20 and 22. The fluid inlet valve 22 is confined within rack 14 nearest inlet end 16 by a groove 23. The shoulder 28 of the valve 20 is retained within groove 23. The valve further consists of a fluid outlet slot 21. A similar one-way valve 22 is positioned nearest fluid exit end 18 held within groove 23, the one-way valve having a fluid exit slot 21 at the exit end of the valve. The one-way valve 20, nearest inlet end 16, passes fluid through the valve into annulus 14 when a series of, for example, weighted ball bearings or spheres, loosely confined within track 14, rotate away from fluid inlet valve 20. The balls or spheres may be fabricated from steel, brass, lead, gold, silver or other heavy formable material. As the balls rotate in the opposite direction, fluid passes around the balls and enters the one-way valve nearest the fluid exit end 18. As the balls reverse direction again, fluid is forced out through slit opening 21 of exit valve 22 and out of the fluid outlet end 18. Ball stops 26 are formed in body halves 15–17 to limit the travel of the weighted balls 24.

The two-cycle internal combustion engine 30 is normally mounted to support beams 34 through engine mount lugs 32. During operation of the two-cycle engine, the pistons reciprocating up and down a cylinder protruding from the engine block causes the engine to also rock rotationally clockwise and counterclockwise on its beam mounts 34. Rocking of the operating engine causes the weighted balls 24 to remain relatively stationary within toroidal annulus 24. The body 12 of the pump confined within recess 36 of backplate 33 rotates past the weighted balls, thus forcing fluid through the one-way valves 20 and 22.

Figure 2:
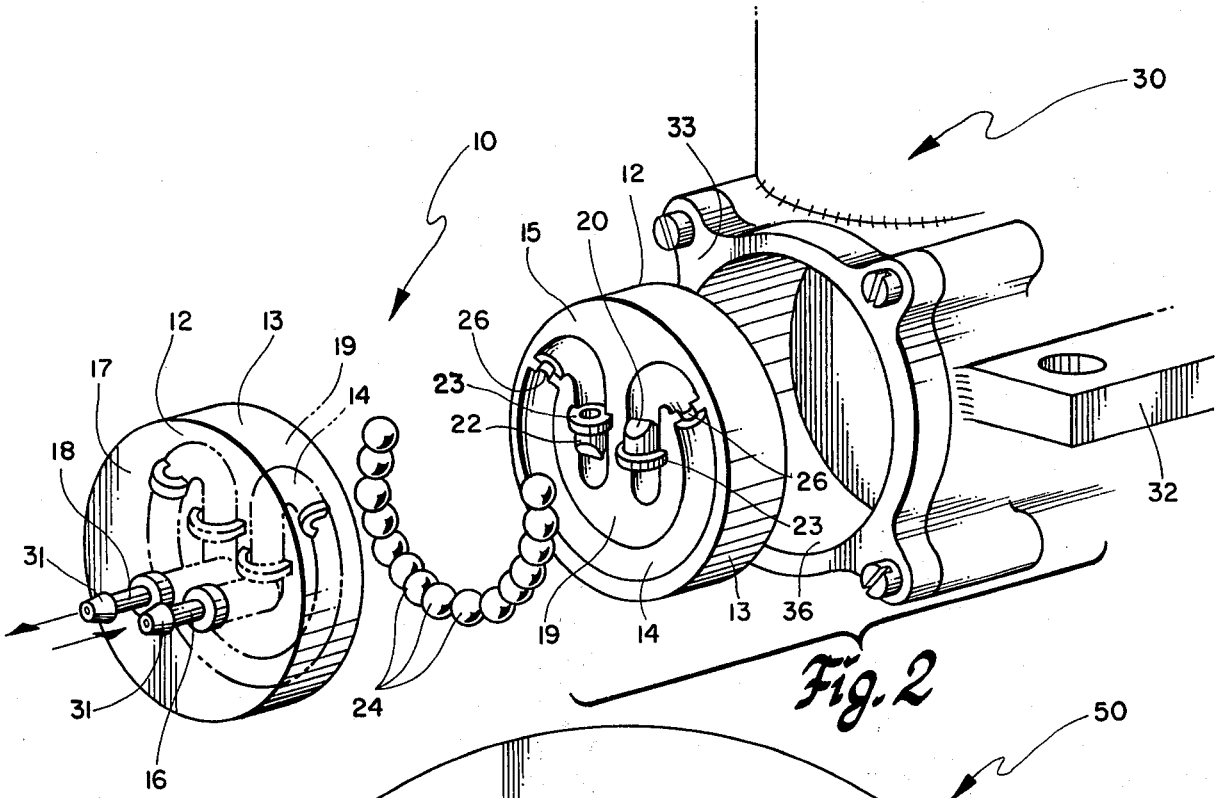
FIG. 2 is an exploded perspective view of a portion of the internal combustion engine with the positive displacement pump being exploded out of the crankcase recess formed by the engine backplate at the rear of the internal combustion engine.

With reference now to FIG. 2, the exploded pump 10 clearly illustrates the relationship of the two halves 15–17 of the body 12 (one-half of the annular torus 14 formed in each half 15 and 17). To assemble the pump, one-way valves 20 and 22 are slipped into their respective grooves 23, followed by insertion of the weighted balls 24 within the toroidal track 14. The outer half 17 of body 12 is subsequently mated to mating surface 19 of half 15. It should be pointed out that room is left in track 14 for the loosely fitted balls 24 to move within the track which, of course, drives the fluid through the positive displacement pump as the engine 30 oscillates back and forth on its mount 32. A pair of nipples 31 are screwed into outer half 17 of the pump to direct fluid in and out of the pump. A source of fluid from a fluid reservoir (not shown) is connected to inlet 16 through nipple 31. The fluid is then pumped through outlet conduit 18 to, for example, a carburetor of an internal combustion engine.

Figure 3:
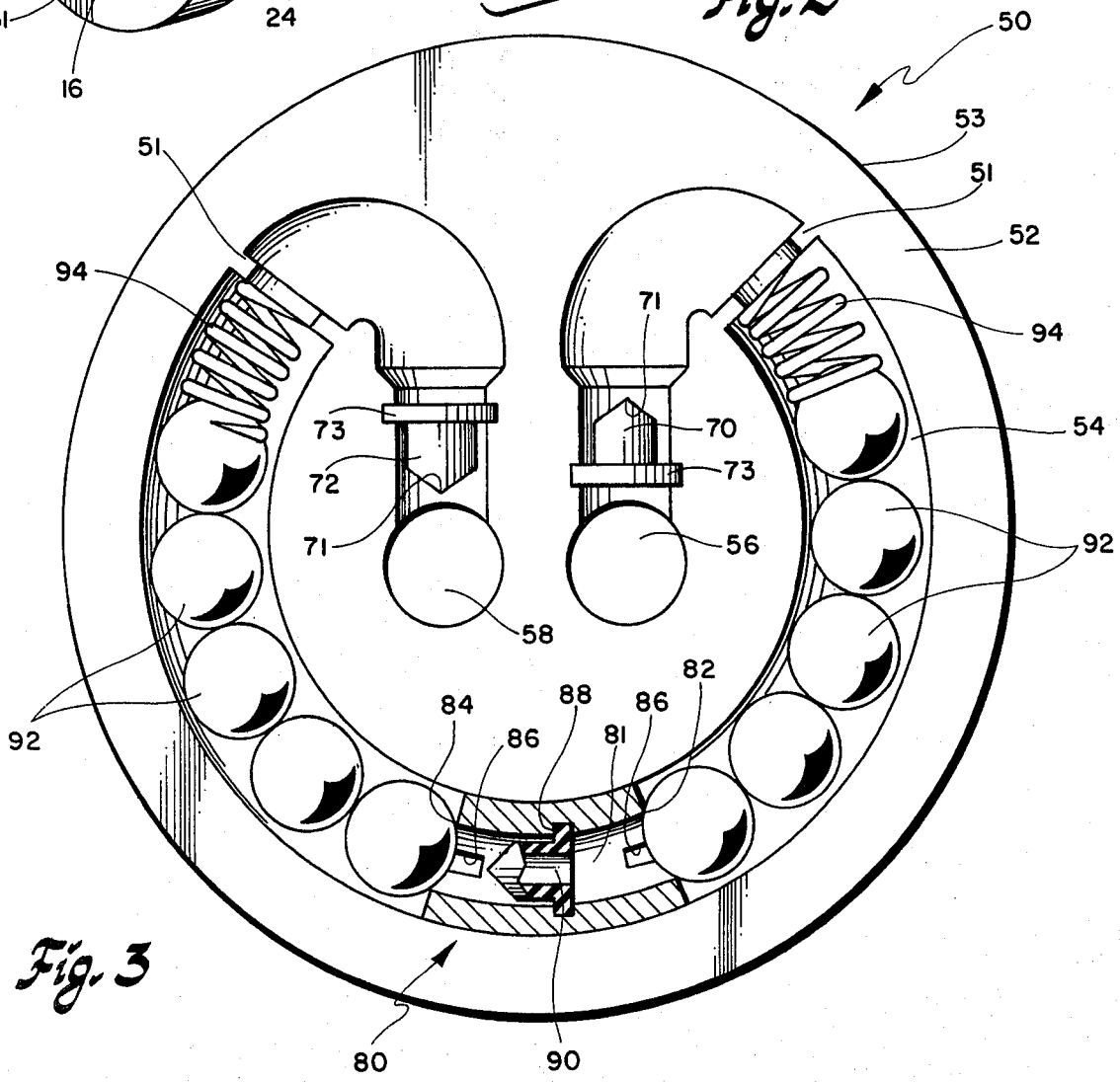
FIG. 3 is a view of an alternative embodiment of the present invention illustrating an annular pump with a positive displacement weight mass piston within the pump that is driven back and forth with the help of a series of weighted ball bearings and springs at opposite ends of the toroidal annulus formed by the pump body.

An alternative embodiment is shown in FIG. 3. The pump, generally designated as 50, utilizes the same principle as described in FIGS. 1 and 2. This embodiment differs however in that a piston weight mass, generally designated as 80, is positioned about half-way within the toroidal track 54. The piston 80 forms an annular orifice 81 through the piston, having a fluid inlet portion 82 and a fluid outlet portion 84. A series of axially aligned slots 86 are provided in ends 82 and 84 to allow fluid to pass by the weighted balls 92 at opposite ends of the piston weight mass 80. Confined within annulus 81 is a one-way valve 90, the valve being retained within the piston weight mass by a groove 88 cut into the piston weight mass 80. A series of balls 92 are positioned at opposite ends 82 and 84 of the piston weight mass, the balls being intimately engaged with ends 82 and 84 by spring means 94 near each end of the toroidal track 54. A spring stop means 51 is formed in the body 52 to retain the springs 94, the balls 92, and the piston weight mass 80 within track 54. The spring means 94 serves to urge the weight mass and the balls back and forth within the toroid 54 during operation of the pump 50. Fluid inlet and outlet valves 70 and 72 are retained within valve retention grooves 73 formed in body 52 of pump 50. Fluid is brought in through port 56 and passes through the one-way valves 70 through slot opening 71 when the piston weight mass moves away from the valve 70. As the piston rotates back toward valve 70, fluid is driven through the one-way valve 90 in the piston weight mass 80 and, as the piston again moves in the opposite direction, fluid is driven out through one-way outlet valve 72 through slot 71. Fluid is then directed out through fluid outlet port 58 within housing 50. The positive displacement pump of FIG. 3 would be mounted within the recess area 36 in backplate 33 of the two-cycle internal combustion engine 30.

Figure 4:
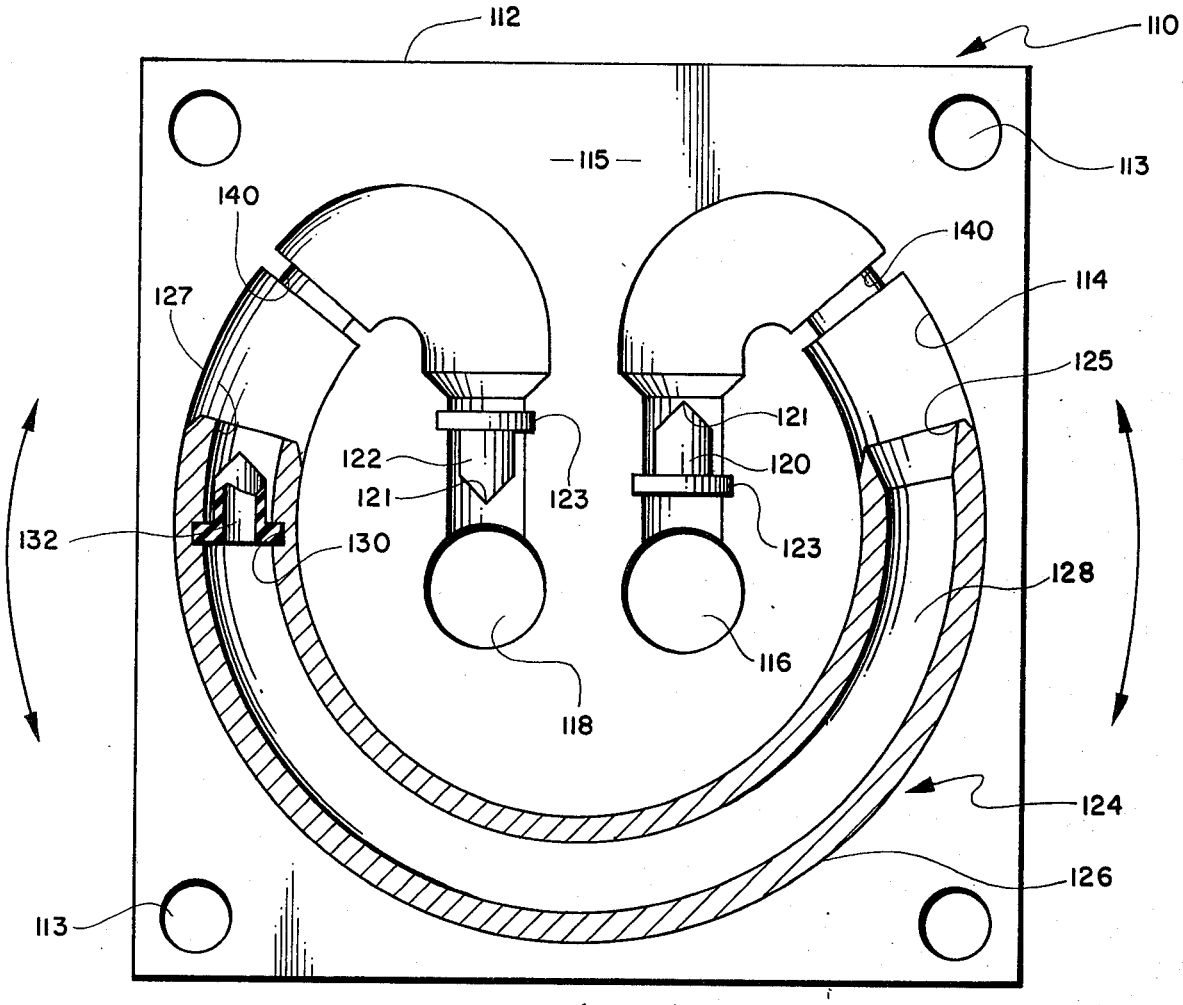
FIG. 4 is yet another view of a slightly different annular positive displacement pump which utilizes a large annular, hollow piston weight mass in place of a series of weighted balls within the channel. The annular piston oscillates clockwise and counterclockwise within the annular channel associated therewith.

Turning now to FIG. 4, yet another embodiment of the invention is disclosed wherein an annular piston weight mass, generally designated as 124, takes up the majority of the annular torus 114 (more than 75% of the track of torus 114). Obviously, a weight mass 124 shorter in its toroidal length would also be effective. The annular weight mass 124 defines an internal channel 128, having an inlet opening 125 nearest inlet 116 and an exit opening 127 nearest fluid outlet 118. A one-way valve 132 is confined within the annulus 128 within weight mass 124 by a valve retention groove 130. Like the other positive displacement pumps previously described, as the weight mass 124 moves away from the fluid inlet valve 120, fluid is drawn through fluid inlet 116 through valve 120, out through slot opening 121 and into the area behind valve 132 in the piston weight mass. As the piston weight mass rotates toward inlet valve 120, fluid is driven through the opening 121 in one-way valve 132, admitting fluid in the chamber between the piston weight mass and the fluid exit valve 122. As the piston again reverses direction toward fluid outlet 118, fluid is driven through one-way fluid outlet valve 122, through opening 121 and out through fluid exit 118. The housing 112 has a series of mounting holes 113 so that the housing 112 can be mounted to, for example, an electric motor that is wired to rotate clockwise and counterclockwise.

Figure 5:
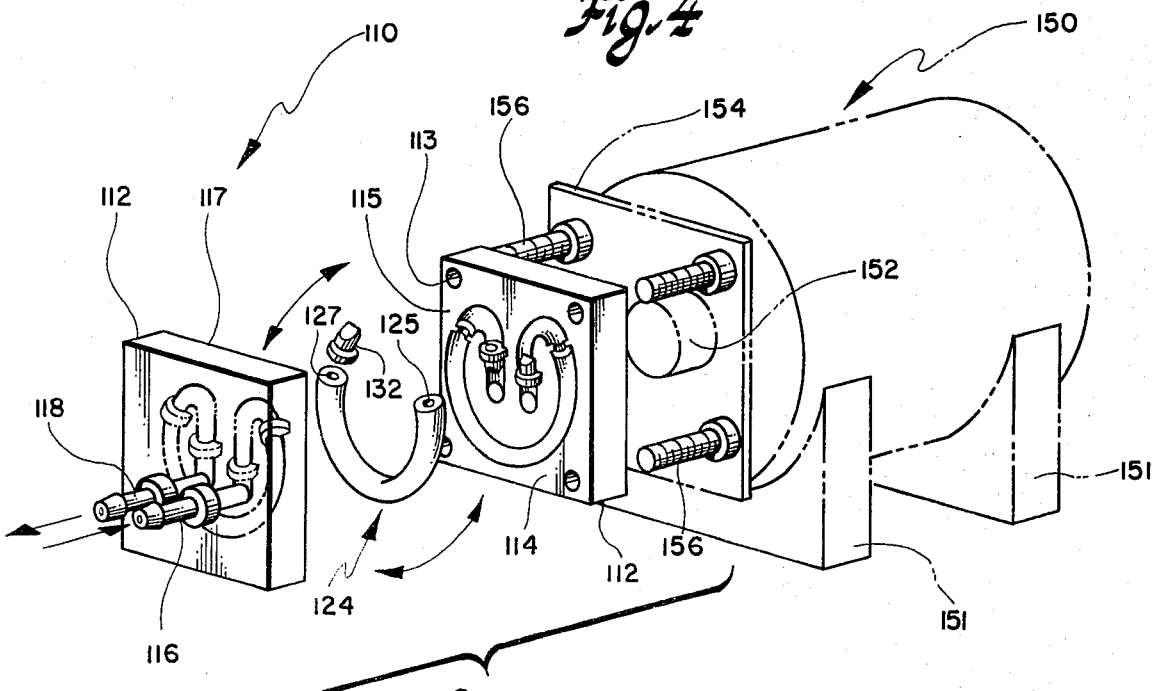
FIG. 5 is an exploded perspective view of the pump illustrated in FIG. 4. The pump is attached to an electric motor (in phantom), the motor being designed to oscillate clockwise and counterclockwise at different rates.

With reference now to FIG. 5, the electric motor, generally designated as 150 (in phantom), is mounted to a support base (not shown) through mounting plates 151. The electric motor, for example, is specifically designed to rotate clockwise and then back counterclockwise without making a full 360° rotation. The back and forth motion is controlled electronically through state of the art electronics to determine the rate at which the back and forth rotational motion is controlled. A mounting plate 154 is attached to shaft 152 of the electric motor. The positive displacement pump 110 is mounted to plate 154 through screws 156, tapped into the positive displacement pump body 112 through mounting holes 113 positioned therein. The clockwise, counterclockwise motion generated by the special electric motor causes the body 112 of the positive displacement pump 110 to rotate clockwise and counterclockwise via mounting plate 154. The piston weight mass 124 tends to remain stationary as the body 112 rotates and slides around the weight mass, thus forcing fluid through the series of one-way valves, out of the pump 110. The special motor 150 can be controlled, for example, by a rheostat to very slowly swing the pump 110 to drive fluid through the pump at a certain, very precise rate per hour. The pump then would be ideal for use as a means to administer, for example, medication to a patient. The simplicity and reliability of the pump makes it an ideal tool for the medical profession.

There are many different applications of this type of rotational positive displacement pump, a few of which have been described. It would be obvious, for example, to mount this type of positive displacement pump adjacent any type of engine to, for example, pump a combustible fluid to the engine.

It would also be obvious to use this pump to drive bilge water out of a ship. For example, the pump could be attached to a self-contained motor, the apparatus being submerged in the bilge, to provide a very positive means to drive bilge water from the ship.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A positive displacement fluid pump actuated by a clockwise, counterclockwise rotary motion comprising:

a housing, said housing forming fluid inlet and fluid outlet means, an annular channel, circular in cross section, formed by said housing, a first end of said annular channel is in fluid communication with said inlet, a second end of said annular channel is in fluid communication with said fluid outlet means formed in said housing, a first one-way valve means, positioned in said channel between said fluid inlet means in said housing and said first end of said channel, a second one-way valve means positioned in said channel between said fluid outlet means in said housing and said second end of said channel, a first free-moving piston weight mass positioned about half-way between said first and second ends of said channel, said piston forming a passageway therethrough, a third one-way valve means being retained within said passageway by said piston means, a source of fluid connected to said fluid inlet, and a source of rotary osctillatory energy adjacent said housing, said rotary oscillatory motion rotates said housing clockwise and counterclockwise at varying rates of oscillation, as said positive displacement piston weight mass moves away from said first inlet end of said annular channel, fluid is drawn through said first one-way valve means into an expanded area behind said piston, as said piston reverses direction, said fluid passes through the third one-way valve within said piston into a chamber adjacent said second end of said annular channel, as said piston again reverses direction, the third valve closes in the piston and fluid is forced out past said second one-way valve nearest said outlet end of said housing, thereby pumping fluid through said positive displacement pump.

* * * * *